United States Patent [19]

Kim

[11] Patent Number: 4,463,237

[45] Date of Patent: Jul. 31, 1984

[54] PUSHBUTTON ASSEMBLY WITH INTEGRAL BIAS MEANS

[75] Inventor: Syng N. Kim, Hoffman Estates, Ill.

[73] Assignee: Wico Corporation, Niles, Ill.

[21] Appl. No.: 484,448

[22] Filed: Apr. 13, 1983

[51] Int. Cl.[3] ..... H01H 3/12

[52] U.S. Cl. ..... 200/340

[58] Field of Search ..... 400/491.2; 200/340, 200/5 A, 276

[56] References Cited

U.S. PATENT DOCUMENTS

| | | | |
|---|---|---|---|
| 3,582,594 | 6/1971 | Twyford | 200/340 |
| 3,641,286 | 2/1972 | Berezowski | 200/5 A |
| 3,761,919 | 9/1973 | Baumann | 400/491.2 X |
| 3,808,389 | 4/1974 | Ramsay et al. | 200/159 A |
| 3,974,351 | 8/1976 | Solov et al. | 200/340 X |
| 4,066,860 | 1/1978 | Kawasaki | 200/340 X |
| 4,197,440 | 4/1980 | Debaigt | 200/340 X |
| 4,282,414 | 8/1981 | Johnston et al. | 200/340 X |

FOREIGN PATENT DOCUMENTS

| | | | |
|---|---|---|---|
| 1301384 | 8/1969 | Fed. Rep. of Germany | 200/159 A |

*Primary Examiner*—John W. Shepperd
*Assistant Examiner*—Renee S. Kidorf
*Attorney, Agent, or Firm*—Dithmar, Stotland, Stratman & Levy

[57] ABSTRACT

A pushbutton assembly for a switch includes a cylindrical housing having an axial bore therethrough, one end of the housing being enlarged to define a cup-shaped cavity communicating with the bore. An elongated tubular actuator body is reciprocally movable in the bore. At one end of the body and received in the cavity is an inverted cup-shaped head having an end wall and a cylindrical side wall. The other end of the body is bifurcated to define flexible legs. An annular recess in the body adjacent to the upper ends of the legs receives an annular projection on the body for limiting axial movement of the actuator. Unitary with the head are three elongated flexible resilient bias members engageable with the housing for resiliently biasing the actuator to a normal rest position. Two embodiments are disclosed, one in which the bias members are intergral with the head side wall and another in which the bias members are integral with the head end wall.

12 Claims, 8 Drawing Figures

PUSHBUTTON ASSEMBLY WITH INTEGRAL BIAS MEANS

BACKGROUND OF THE INVENTION

The present invention relates to pushbutton assemblies for actuating electrical switches and in particular to bias means for resiliently urging the pushbutton to its normal rest position.

Prior pushbutton assemblies have typically included a pushbutton actuator disposable in an associated housing or receptacle. Typically, some form of bias spring is provided for engaging the pushbutton actuator, resiliently to urge it to a normal rest position. The bias means is frequently in the form of a helical compression spring. This arrangement necessitates an additional part, increasing the cost of manufacture and assembly.

It is known to provide pushbutton assemblies with spring-type bias means which are integral with the pushbutton member. Such integral bias means are disclosed, for example, in U.S. Pat. Nos. 4,218,599, 4,066,860 and 3,808,389. In the '389 patent, the bias means is an annular accordion-pleated member which is quite complicated and expensive to manufacture and which causes high stresses in the plastic material of the bias member. The integral bias members of the other aforementioned patents extend laterally outwardly well beyond the periphery of the pushbutton, and therefore, cannot be used in the standard pushbutton receptacles.

SUMMARY OF THE INVENTION

It is a general object of this invention to provide an improved pushbutton assembly which avoids the disadvantages of prior assemblies, while affording additional structural and operating advantages.

An important object of this invention is the provision of a pushbutton assembly which utilizes an integral bias means which is of simple and economical construction.

In connection with the foregoing object, it is another object of this invention to provide a pushbutton assembly of the type set forth, wherein the pushbutton actuator carries the integral bias means in such a way that the actuator is receivable in a standard housing receptacle.

In connection with the foregoing objects, it is still another object of this invention to provide a pushbutton assembly of the type set forth, wherein the integral bias means provides no frictional interference with the associated housing.

Yet another object of this invention is the provision of a pushbutton assembly of the type set forth, which includes improved means for retaining the pushbutton actuator in the housing.

These and other objects of the invention are attained by providing a pushbutton actuator comprising a body, an enlarged pushbutton head carried by the body at one end thereof and extending laterally outwardly therefrom around the entire perimeter thereof, and a plurality of flexible resilient bias members unitary with the head and extending therefrom along the body generally toward the other end of the body, each of the bias members having a curved distal end spaced from the body and deflectable generally back toward the one end of the shaft.

The invention consists of certan novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings two embodiments thereof, from an inspection of which, when considered in connection with the following description, the invention, its construction and operation, and many of its advantages should be readily understood and appreciated.

DESCRIPTION OF THE PREFERRED EMBODIMENTS

Figure 1:
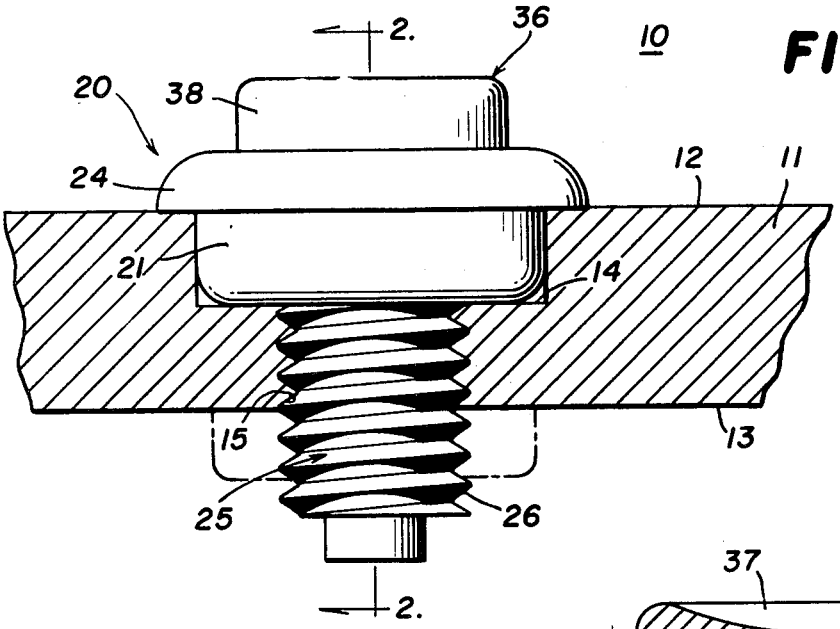
FIG. 1 is a fragmentary view in vertical section of a portion of a support panel having mounted therein a pushbutton assembly constructed in accordance with and embodying the features of a first embodiment of the present invention, the pushbutton assembly being illustrated in side elevation.

Referring now to FIGS. 1–4 of the drawings, there is illustrated a pushbutton assembly generally designated by the numeral 10, constructed in accordance with and embodying the features of a first embodiment of the present invention. The pushbutton assembly 10 is adapted for mounting on a support panel 11 having an outer surface 12 and an inner surface 13. More particularly, a cylindrical recess 14 is formed in the outer surface 12 of the support panel 11, the inner end of the recess 14 communicating centrally thereof with an internally-threaded bore 15 extending through the support panel 11.

The pushbutton assembly 10 includes a housing 20 and an actuator 30. The housing 20 has a cylindrical side wall 21 closed at one end thereof by a circular end wall 22 for defining a generally cup-shaped cavity 23. The other end of the side wall 21 is provided with a laterally outwardly extending annular lip 24. Integral with the end wall 22 and projecting therefrom coaxially therewith is a cylindrical shank 25 which is provided with external threads 26. A cylindrical bore 27 extends axially through the shank 25 and communicates with the cavity 23 centrally thereof.

The actuator 30 includes an elongated cylindrical shaft 31 having a conical bore 32 extending axially thereinto from one thereof substantially the entire length therof. The shaft 31 has an outer diameter slightly less than the inner diameter of the bore 27 in the housing 20. One end of the shaft 31 is longitudinally bifurcated to define a pair of spaced flexible, resilient legs 33, each of which is provided at its distal end with a laterally outwardly extending projection 34 which cooperates with the shaft 31 to define a part-annular shoulder 35. Integral with the shaft 31 at the other end thereof is an enlarged pushbutton head, generally designated by the numeral 36, which is generally in the shape of an inverted cup. More specifically, the pushbutton head 36 has a concave circular end wall 37 coaxial with the shaft 31 and having a diameter substantially greater than that of the shaft 31. The end wall 37 is integral at its peripheral edge with a depending cylindrical skirt or side wall 38 which is coaxial with the shaft 31 and has an outer diameter slightly less than the inner diameter of the cavity 23 in the housing 20. Three equiangularly spaced apart radial stiffening webs 39 are provided in the pushbutton head 36, each of the webs 39 being integral with the end wall 37 and extending from the shaft 31 to the side wall 38.

Figure 2:
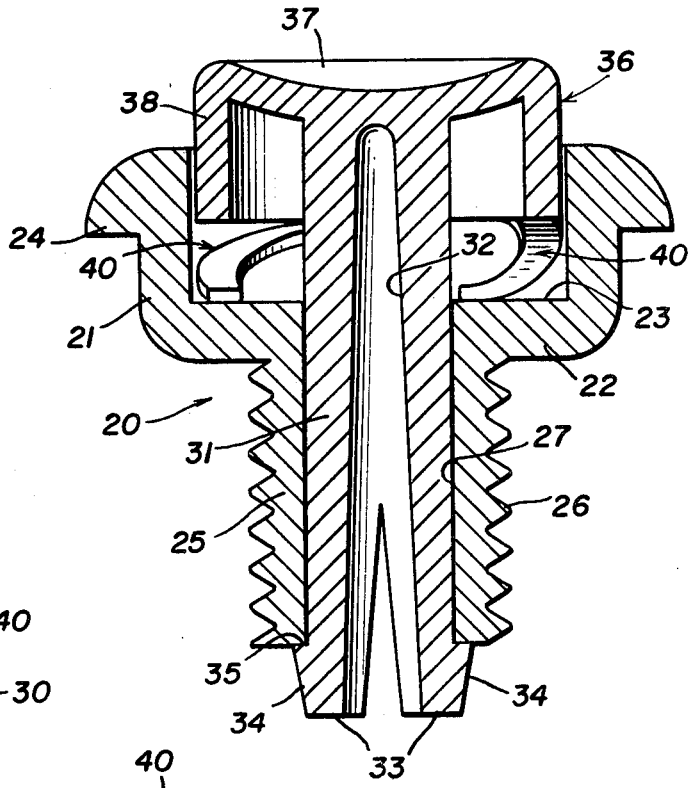
FIG. 2 is an enlarged view in vertical section taken along the line 2—2 in FIG. 1, with the support panel removed.
Figure 3:
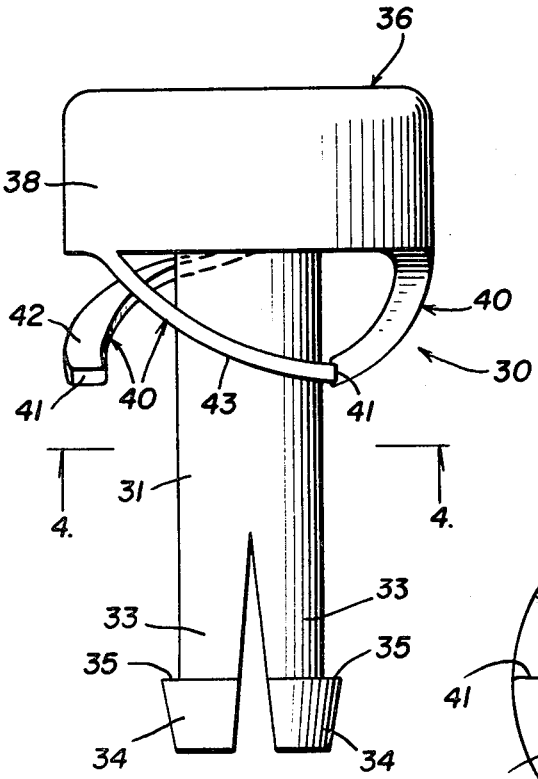
FIG. 3 is a side elevational view of the actuator of the pushbutton assembly of FIG. 2.
Figure 4:
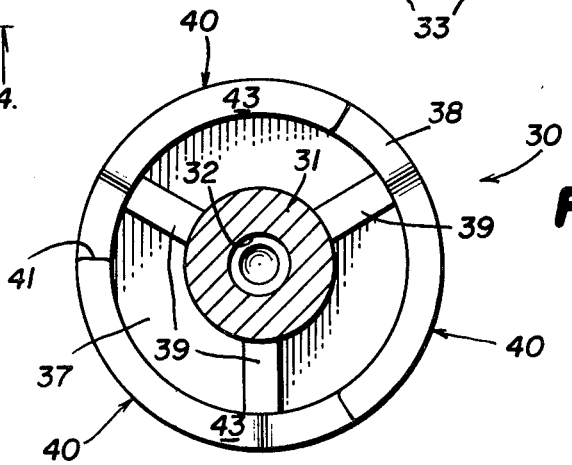
FIG. 4 is a view in horizontal section taken along the line 4—4 in FIG. 3.
Figure 5:
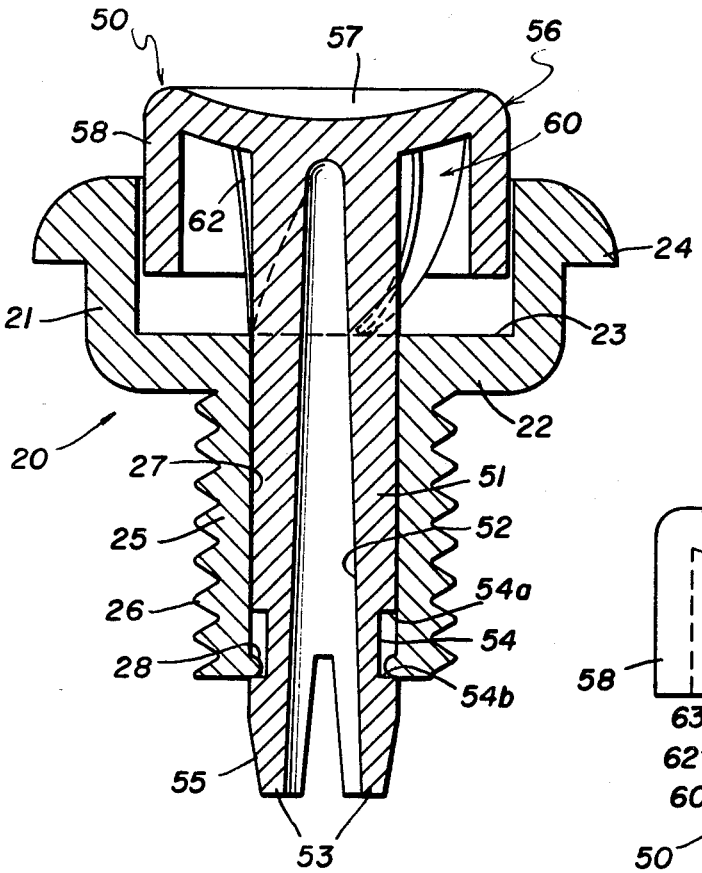
FIG. 5 is a view similar to FIG. 2, illustrating another embodiment of the pushbutton assembly of the present invention.

Integral with the side wall 38 at the distal end thereof are three equiangularly spaced apart bias members 40. Each of the bias members 40 comprises an elongated curved member extending from the distal edge of the side wall 38 in cantilever fashion and terminating at a distal end 41. Each of the bias members 40 is a generally flat elongated member which is generally helically curved around the shaft 31 in a counterclockwise direction, as viewed from the head end of the actuator 30. Each bias member 40 has a flat upper surface 42 and a flat lower surface 43, the bias member 40 being curved so that the lower surface 43 adjacent to the distal end 41 is disposed for engagement with the end wall 22 of the housing 20 at the bottom of the cavity 23, as is best illustrated in FIG. 2. Preferably, the bias members 40 are arranged so that the laterally outer edges thereof are substantially tangent to an imaginary cylinder which is an extension of the outer surface of the side wall 38 of the head 36.

It is a significant aspect of the present invention that the actuator 30 is of unitary one-piece construction, preferably being molded of a suitable plastic. Similarly, the housing 20 is preferably a molded plastic part. The pushbutton assembly 10 is assembled by inserting the shaft 31 of the actuator 30 into the bore 27 of the housing 20 from the head end thereof, the legs 33 being resiliently deflectable toward each other to accommodate this insertion and passage thereof through the bore 27. When the projections 34 at the ends of the legs 33 clear the distal end of the bore 27, the legs 33 snap back to their normal rest position, with the shoulders 35 engaging the distal end surface of the shank 25 to prevent accidental removal of the actuator 30 from the housing 20.

As is best shown in FIG. 2, when the actuator 30 is thus assembled with the housing 20, the distal ends 41 of the bias members 40 engage the housing end wall 22 at the bottom of the cavity 23 and are deflected thereby back toward the push button head 36. Thus, the bias members 40 serve resiliently to urge the actuator 30 to a normal rest position, illustrated in FIG. 2, with the shoulders 35 held against the end of the shank 25 and with the pushbutton head 36 of the actuator 20 projecting a predetermined distance outwardly from the cavity 23 for access by the user. In operation, the user depresses the actuator 20 by pushing on the pushbutton head 36 in a known manner, thereby moving the shaft 31 axially through the bore 27 against the urging of the bias members 40. The shaft 31 may be coupled to an associated switch in a well known manner for actuation thereof. The depth of insertion of the pushbutton head 36 in the cavity 23 is limited by flattening out of the bias members 40 between the head side wall 38 and the housing end wall 22.

Referring now to FIGS. 5–8 of the drawings, there is illustrated another embodiment of the pushbutton assembly of the present invention, which utilizes a different type of actuator, generally designated by the numeral 50. This pushbutton assembly includes a housing 20 which is substantially identical to that of the pushbutton assembly 10, with the exception that the shank 25 is provided adjacent to its distal end with an annular projection 28 (see FIG. 5) which extends radially inwardly of the bore 27 for a purpose to be explained more fully below.

The actuator 50 includes an elongated cylindrical shaft 51 having a conical bore 52 formed axially in one end thereof and extending substantially the entire length thereof. One end of shaft 51 is longitudinally bifurcated to form a pair of spaced flexible resilient legs 53. Formed in the outer surface of the shaft 51 adjacent to the inner ends of the legs 53 is an annular recess 54 extending circumferentially around the shaft 51, the recess 54 having a predetermined axially length and defining a annular upper end surface **54*a* and a annular lower end surface 54*b*. The outer surfaces of the legs 53 are tapered toward the distal ends thereof, as at 55**.

Integral with the shaft 51 at the other end thereof is an enlarged, cylindrical pushbutton head 56 which is generally in the shape of an inverted cup. More specifically, the pushbutton head 56 has a concave circular end wall 57 integral with the shaft 52 coaxially therewith and having a diameter substantially greater than the outer diameter of the shaft 51. Integral with the end wall 57 around the outer perimeter thereof and depending therefrom is a cylindrical skirt or side wall 58 disposed substantially coaxially with the shaft 51. The side wall 58 has an outer diameter slightly less than the inner diameter of the recess 23, while the shaft 51 has an outer diameter slightly less than the inner diameter of the bore 27. Equiangularly spaced apart within the pushbutton head 56 are three radially extending stiffening webs 59, each integral with the end wall 57 and extending radially from the shaft 51 to the side wall 58.

Figure 8:
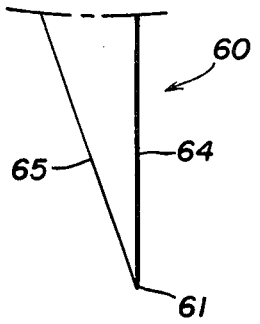
FIG. 8 is a diagrammatic view of one of the bias members of the pushbutton assembly of FIG. 5, flattened out in a plane.
Figure 6:
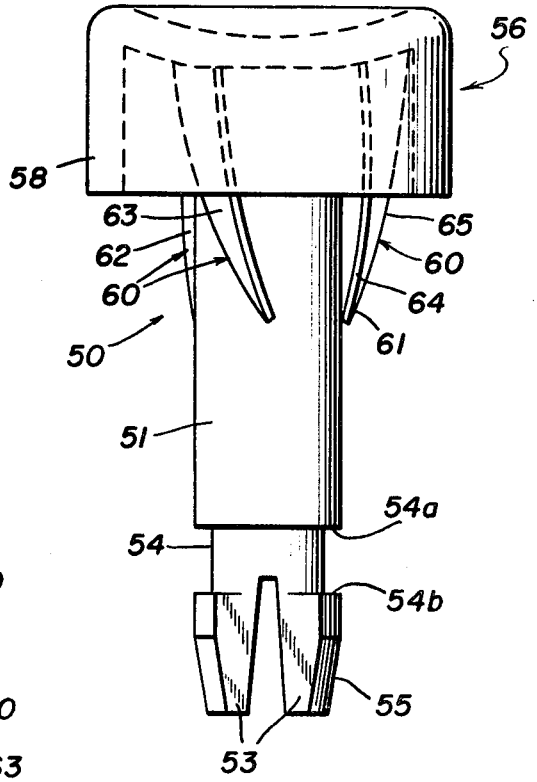
FIG. 6 is a side elevational view of the actuator of the push button assembly of FIG. 5.
Figure 7:
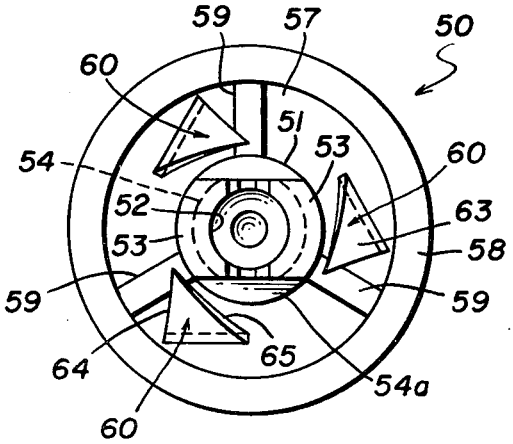
FIG. 7 is a bottom plan view of the actuator of FIG. 6.

Integral with the inner surface of the end wall 57 are three equiangularly spaced apart bias members 60, each of which comprises an elongated, flexible, resilient member terminating at a distal end 61 which extends axially beyond the distal end of the head side wall 58. Each of the bias members 60 is integral with the end wall 57 at a point spaced from both the shaft 51 and the side wall 58 and is generally helically curved around the outside of the shaft 51. Each of the bias members 60 has an upper surface 62 and a lower surface 63 and is curved so that the lower surface 63 is disposed for engagement with the end wall 22 of the housing 20 at the bottom of the cavity 23. Referring to FIG. 8, each of the bias members 60, when laid flat, is substantially in the form of a right triangle having a long side edge 64 which extends substantially parallel to the longitudinal axis of the shaft 51, and a hypotenuse edge 65. Thus, when the bias member 60 is curved around the shaft 51 it remains spaced therefrom, as is best illustrated in FIG. 7.

It is a significant aspect of this invention that the actuator 50 is of unitary one-piece construction, preferably molded of a suitable plastic material. In assembly, the actuator 50 is assembled with the housing 20 in much the same manner as was explained above with respect to the embodiment of FIGS. 1–4. Thus, the shaft 50 is inserted downwardly through the bore 27 from the head end thereof, the legs 53 being resiliently deflected toward each other to accommodate camming past the projection 28, until the projection 28 rides into the recess 54, whereupon the legs 53 snap back to their normal rest position with the lower end surface **54*b* of the recess 54 engaging the projection 28, effectively to prevent accidental removal of the actuator 50 from the housing 20. In this position, it will be noted from FIG. 5, that the distal ends 61 of the bias members 60 engage the housing end wall 22 and are deflected thereby back toward the pushbutton head 56, resiliently to urge the actuator 50 to a normal rest position, illustrated in FIG. 5, wherein the lower end surface 54*b* of the recess 54 is held against the projection 28, and the pushbutton head 56 projects a predetermined distance outwardly from the cavity 23** for access by a user.

In use, the pushbutton head 56 is depressed into the cavity 23 against the urging of the bias members 60, for moving the shaft axially through the bore 27 for actuation of an associated switch or the like in a well known manner. The depth of insertion of the pushbutton head 56 into the cavity 23 is limited by engagement of the projection 28 with the upper end surface **54*a* of the recess 54. It will be noted that the bias members 60 are disposed well inwardly from the cylindrical side wall 21 of the housing 20, thereby to ensure that there will be no frictional engagement of the bias members 60 with the housing side wall 21. When the pushbutton head 56 is depressed into the cavity 23, the bias members 60 are deflected back toward the head 56, the shape of the bias members 60 being such that they curve helically around the shaft 51** but remain spaced therefrom, thereby preventing frictional engagement therewith.

It will also be appreciated that the pushbutton assembly of the present invention can be readily assembled and disassembled without the use of tools. In this regard, for disassembly the legs 33 or 53 can be deflected toward each other to permit withdrawal of the actuator 30 or 50 from the associated housing 20.

It is a significant feature of the present invention that the arrangement of the actuators 30 and 50 with three integral bias members provides a simple and economical construction which can be easily molded, the bias members 40 and 60 being deflectable in use without generating undue stresses therein. Furthermore, there has been provided a unitary one-piece acutator with integral bias means which is usable with a substantially standard cylindrical pushbutton housing, while avoiding any frictional interference between the bias members and the housing. While in the preferred embodiments three bias members have been provided, it will be appreciated that a different number of bias members could be used.

I claim:

1. A pushbutton assembly comprising a housing including a peripheral side wall and an end wall closing said side wall at one end thereof and cooperating therewith to define a cavity, said end wall having an aperture therethrough, an actuator body extending through said aperture in said end wall for sliding reciprocating movement axially thereof, said actuator body having an enlarged pushbutton head at one end thereof disposed in said cavity, and a flexible resilient blade-shaped bias member unitary with said head and extending therefrom toward said end wall in non-encircling relationship with said body, said bias member terminating at a curved free distal end spaced from said body and disposed so that no portion thereof projects laterally outwardly beyond the lateral periphery of said head, said distal end of said bias member being disposed for engagement with said end wall and deflection thereby back toward said head resiliently to urge said actuator body to a normal rest position wherein said head is spaced from said end wall.

2. The pushbutton actuator of claim 1, wherein said head is unitary with said body.

3. The pushbutton actuator of claim 1, wherein said head is generally in the shape of an inverted cup having an end wall and a peripheral side wall integral with said end wall around the perimeter thereof and depending therefrom and terminating at a distal end.

4. The pushbutton actuator of claim 1, including a plurality of said bias members equiangularly spaced apart around said head.

5. The pushbutton assembly of claim 1, wherein said body is substantially cylindrical in shape, said bias member being generally helically curved around said body.

6. The pushbutton assembly of claim 1, wherein said head includes three of said resilient bias members equiangularly spaced around said head.

7. The pushbutton assembly of claim 1, wherein said head is generally in the shape of an inverted cup having an end wall and a peripheral side wall integral with said end wall around the perimeter thereof and depending therefrom and terminating at a distal end, said bias member being integral with said end wall intermediate said body and said peripheral side wall and having the distal end thereof projecting beyond the distal end of said peripheral side wall.

8. The pushbutton actuator of claim 1, wherein said body comprises an elongated hollow tubular member.

9. The pushbutton actuator of claim 8, wherein the other end of said body is axially divided to define a plurality of flexible resilient legs.

10. The pushbutton actuator of claim 9, wherein said body has an axially elongated recess formed in the outer surface thereof.

11. A pushbutton assembly comprising a housing including a peripheral side wall and an end wall closing said side wall at one end thereof and cooperating therewith to define a cavity, said end wall having an aperture therethrough, an elongated actuator body extending through said aperture in said end wall for sliding reciprocating movement axially thereof, said actuator body having an enlarged pushbutton head at one end thereof disposed in said cavity, the other end of said body being axially divided to define a plurality of flexible resilient legs, said body having a recess formed in the outer surface thereof with axially spaced-apart end surfaces, and a projection on said end wall projecting laterally inwardly of said aperture and receivable in said recess, said recess accommodating reciprocating sliding movement of said body in said aperture between a normal rest position wherein said projection is disposed at one end surface of said recess and an actuating position wherein said projection is disposed adjacent to the other end surface of said recess, and a flexible resilient blade-shaped bias member unitary with said head and extending therefrom along said body toward the other end of said body in non-encircling relationship therewith, said bias member terminating at a curved free distal end spaced from said body and disposed so that no portion thereof projects laterally outwardly beyond the lateral periphery of said head, said distal end of said bias member being disposed for engagement with said end wall and deflection back toward said head resiliently to urge said actuator body to the normal rest position thereof.

12. The pushbutton assembly of claim 11, wherein said body is cylindrical in shape, said recess extending circumferentially around said body, said projection being annular in shape and extending around the circumference of said aperture.

* * * * *